United States Patent [19]

Hama

[11] Patent Number: 4,813,262

[45] Date of Patent: Mar. 21, 1989

[54] METHOD FOR FORMING LOOP-SHAPED STARTING PIECES SUCH AS METALLIC BINDING BANDS INTO PRESCRIBED FINAL SHAPES

[75] Inventor: Taira Hama, Chino, Japan

[73] Assignee: Kabushiki Kaisha Mihama Seisakusho, Chino, Japan

[21] Appl. No.: 113,567

[22] Filed: Oct. 26, 1987

Related U.S. Application Data

[62] Division of Ser. No. 30,712, Mar. 25, 1987.

[30] Foreign Application Priority Data

Jun. 10, 1986 [JP] Japan ..... 61-134049

[51] Int. Cl.[4] ..... B21D 53/16

[52] U.S. Cl. ..... 72/393; 72/370; 72/399

[58] Field of Search ..... 72/393, 402, 415, 370, 72/399; 29/235, 235.5, 33 A, 33 Q, 33.5; 140/88; 53/585, 291

[56] References Cited

U.S. PATENT DOCUMENTS

| | | | |
|---|---|---|---|
| 1,153,480 | 9/1915 | Beugler . | |
| 1,494,128 | 5/1924 | Primrose . | |
| 1,669,053 | 5/1928 | Hamel | 29/235 |
| 1,955,949 | 4/1934 | Colton | 29/235.5 |
| 2,740,456 | 4/1956 | Laval, Jr. . | |
| 3,281,927 | 11/1966 | Buslaff | 29/235.5 |
| 4,530,231 | 7/1985 | Main | 72/393 |

FOREIGN PATENT DOCUMENTS

| | | | |
|---|---|---|---|
| 474991 | 10/1929 | Fed. Rep. of Germany | 72/393 |
| 494042 | 8/1919 | France | 72/393 |
| 977958 | 4/1951 | France | 72/393 |
| 1373990 | 8/1964 | France | 72/399 |

*Primary Examiner*—Daniel C. Crane

*Attorney, Agent, or Firm*—Jordan and Hamburg

[57] ABSTRACT

A method and apparatus are disclosed for reforming the initial shape of an approximately loop-shaped starting piece into a final prescribed loop-shape. A plurality of elongated materials such as wire rods are arranged in parallel at prescribed intervals to define a prescribed looped or cylindrical space having a first diameter. A plurality of pressing means such as pressing plates actuated by cylinders and pistons press free ends of the elongated materials to reduce the diameter of the looped space prescribed by the elongated materials to define a reduced looped space having a second diameter smaller than the first diameter. The free ends of the elongated materials are then inserted within the starting piece. The pressing means are retracted, whereby the free ends of the elongated materials contact the inner surface of the starting piece. A control piece moved in the direction of elongation of the elongated materials is moved to the free ends of the elongated materials within the starting piece, thereby pressing the free ends against an inner surface of the starting piece to reform the shape of the starting piece to the final prescribed loop shape.

1 Claim, 6 Drawing Sheets

METHOD FOR FORMING LOOP-SHAPED STARTING PIECES SUCH AS METALLIC BINDING BANDS INTO PRESCRIBED FINAL SHAPES

This is a division, of application Ser. No. 030,712, filed Mar. 25, 1987.

BACKGROUND OF THE INVENTION

The intended objects for the loop formation according to this invention include metallic binding bands. Metallic binding bands are formed as illustrated in FIGS. 7 and 8.

A metallic binding band 1 is composed of a binding section 2 wherein a band-shaped steel material cut to a prescribed length has been formed in a ring, a lever 3 wherein a band-shaped steel material of a prescribed length has been welded to the connected overlapping ends 2*a* of the binding section 2 and formed in a curved shape, and a retaining piece 4 for fixing the lever 3 wherein a band-shaped steel material cut to a prescribed length has been bent into the shape of a U and welded to a prescribed position on the binding section 2, with both ends bending around the outside of the ring formed by the binding section 2.

The metallic binding band 1 is prepared by cutting the binding section 2, lever 3, and retaining piece 4 separately out of a long steel material, processing them appropriately, welding the retaining piece 4 onto the binding section 2, and welding the lever 3 to the overlapped section 2*a* of both ends of the binding section 2.

However, this method results in a problem that, in welding the lever 3 to the overlapped section 2*a* of the binding section 2, as shown in FIG. 9, the binding section 2 is flattened or the lever 3 is left flat or deformed from its initial arc curve. It follows that some difficulty is experienced in inserting a hose into the binding section 2 and that force is partially applied in clamping, resulting in deterioration of the hose.

There is sometimes a flash at the end section of the connection side of the lever 3 to the binding section 2. In the presence of such a flash at the end 3*a* of the lever 3, when the lever 3 is turned over (clamped) about the end 3*a* of the connecting side of the lever 3 to the binding section 2, there is a possibility that clamping the lever 3 will result in the binding section 2 being cut by the flash at the end 3*a* of the lever 3.

For these reasons, it has become necessary to aftertreat the formed metallic binding band to make the building section 2 exactly circular and to form the lever 3 into an arc.

SUMMARY OF THE INVENTION

Given the above situation, the object of this invention is to provide a loop forming method for transforming deformed sections of metallic binding bands into a prescribed form to yield high-precision metallic binding bands, etc. and to provide a forming machine suitable for this method.

The method of this invention aims at transforming pieces to the re-formed such as half-manufactured loop-shaped metallic binding bands into prescribed forms. A plurality of elongated materials such as wire rods are provided in parallel at prescribed intervals around a prescribed space having a prescribed diameter matching the final prescribed form for the metallic binding band. The diameter of the space prescribed by the wires is reduced by moving the wires radially inwardly towards each other to form a reduced diameter space. The reduced-diameter section is inserted into a loop-shaped starting piece. Then, the reduced-diameter section is expanded by moving the wire rods radially outwardly away from each other and into contact with the starting piece. Pressure is then applied from within the space defined by the wire rods to transform the loop-shaped starting piece into the desired final prescribed form.

In a forming machine constituting one preferable embodiment of this invention, a plurality of elongated materials such as wire rods, arranged at prescribed intervals to define an inner shape having a prescribed diameter to which a starting piece (a half-manufactured loop-shaped metallic binding band) is to be reformed, are fixed on a vertical wall at their back ends. A plurality of pressing plates which move vertically in the direction of elongation of the elongated materials are provided at or about the free forward ends of the elongated materials. When pressed against the free forward ends, the pressing plates reduce the diameter of the original shape prescribed by the elongated material to allow the front free ends of the elongated materials to be inserted within the starting piece having an approximate loop shape. Retraction of the pressing plates allows the free ends of the inserted elongated materials to contact the inner surface of the starting piece. A holding means (comprising a lower mold and a punch) is provided for holding the starting piece. A control piece is provided which travels in the direction of elongation of the elongated materials and within the space prescribed by the elongated materials. The plurality of elongated materials are pressed outwardly by the control piece against the starting piece to reform the starting piece to the original inner shape having a prescribed diameter defined by the elongated materials. An actuator (e.g., a cylinder) is provided for moving the control piece in the direction of elongation. A close-off moving mechanism which drives a slide block supporting the elongated materials, control piece, actuator, etc., is provided to allow the holding means to come relatively close to and withdraw from the elongated materials inserted within the starting piece, thus facilitating entry of the elongated materials within the starting piece.

Thus, prescribed reformation of a starting piece is easily achieved by the simple action of shrinking the space defined by a plurality of elongated materials, inserting the elongated materials into the starting piece and expanding the space defined by the elongated materials to reform the shape of the starting piece.

BRIEF DESCRIPTION OF THE DRAWINGS

FIGS. 1–6 refer to an embodiment of the loop-shaped piece re-forming machine according to this invention, in which:

FIG. 1 is a front plan view;

FIG. 2 is a top plan view;

FIG. 3 is a top plan view illustrating a mechanism for feeding metallic binding bands;

FIG. 4 is a side plan view of the mechanism for feeding metallic binding bands illustrated in FIG. 3;

FIG. 5 is a sectional view for the forming machine taken along the line B—B in FIG. 1;

FIG. 6 is a sectional view for the forming machine taken along the line A—A in FIG. 1;

DETAILED DESCRIPTION OF THE PREFERRED EMBODIMENTS

Preferred embodiments of this invention will be concretely described below.

Figure 1:
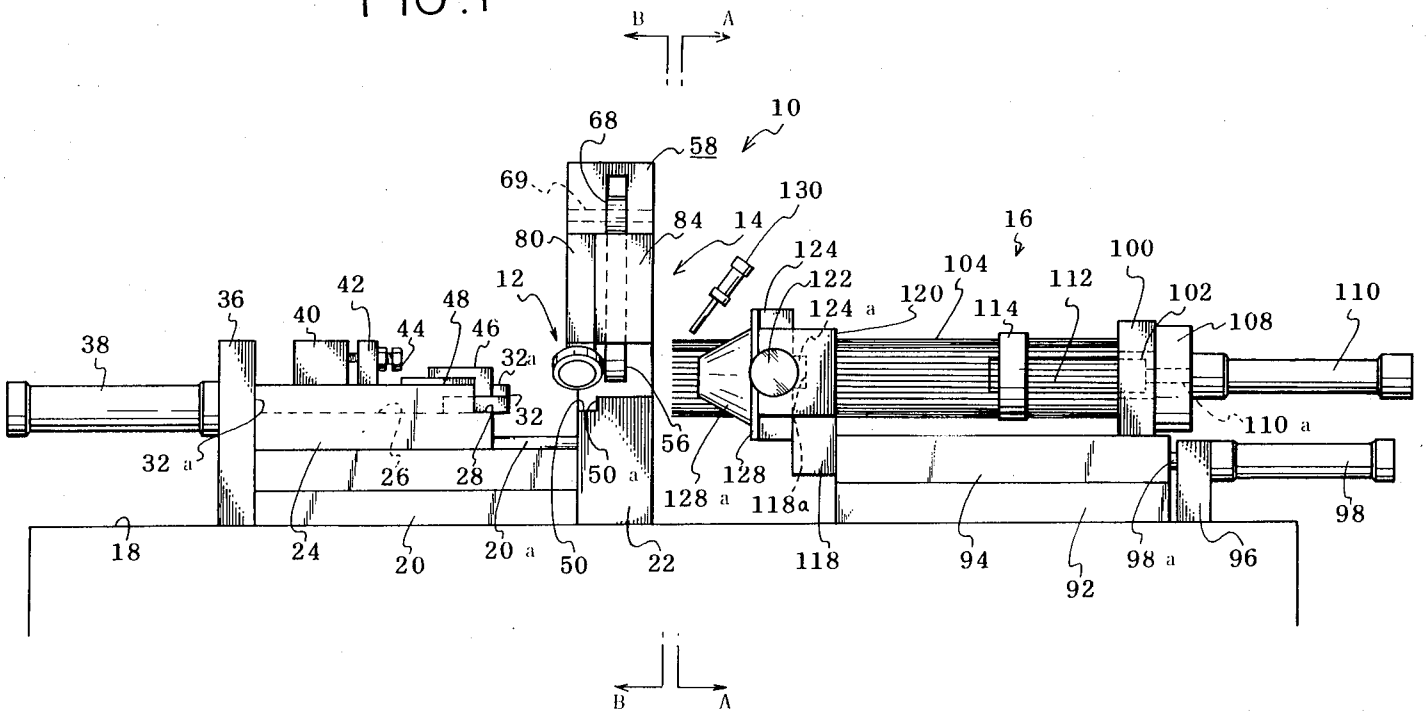
Figure 2:
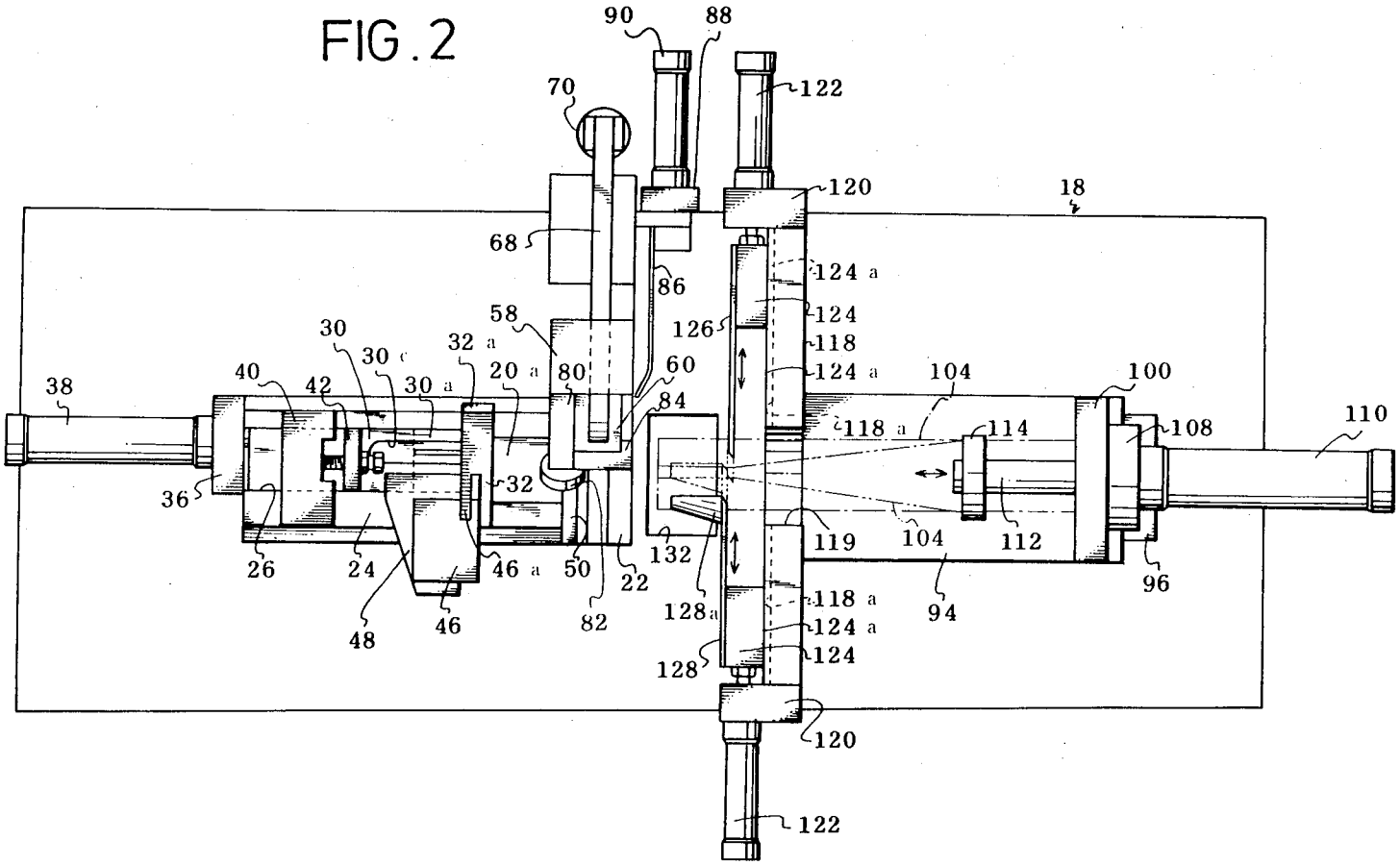
Figure 3:
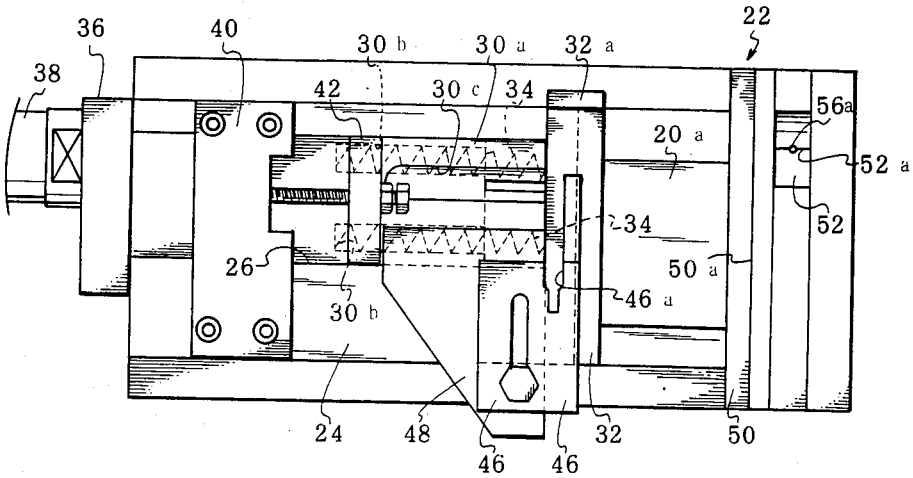
Figure 4:
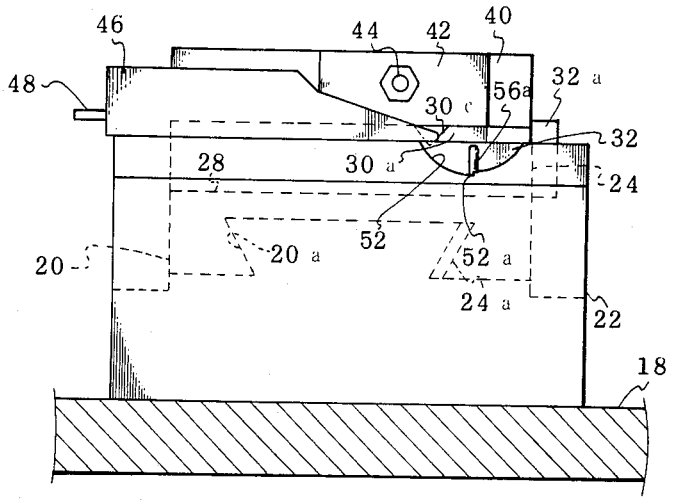
Figure 5:
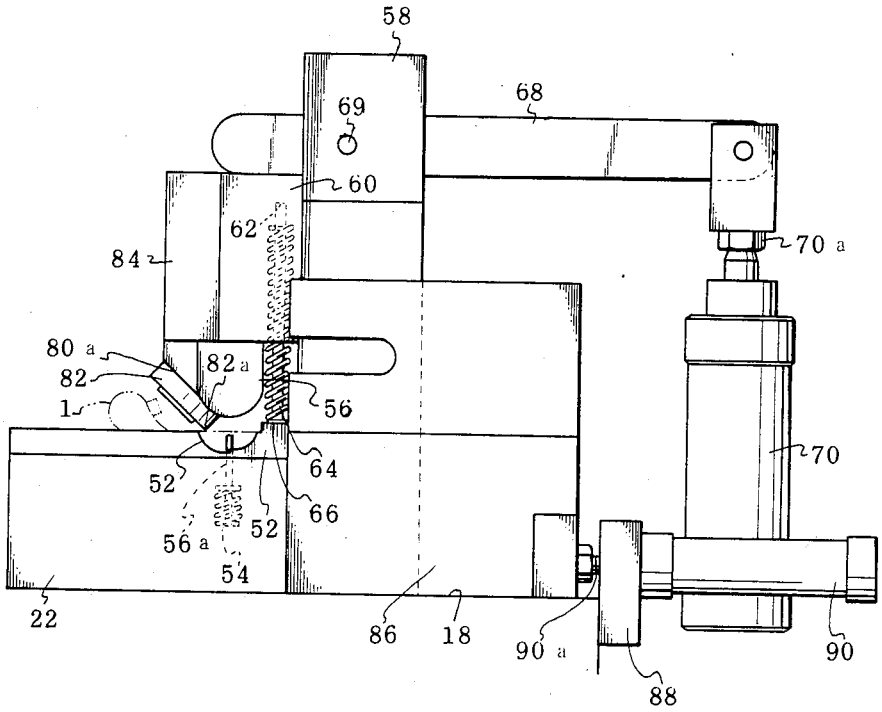

FIG. 1 is a front plan view of a loop forming machine, and FIG. 2 is a top plan view thereof.

A forming machine 10 according to this invention comprises a deflashing mechanism 12 for removing the flash from the lever 3 of a metallic binding band 1, a lever forming mechanism 14 for forming the lever 3 of the metallic binding band 1 into an arc, and a loop forming mechanism 16 for forming the binding section 2 of the metallic binding band 1 into a circle.

First, referring to FIGS. 1–5, the deflashing mechanism 12 and lever forming mechanism 14 will be described.

On the left side of a machine frame 18 supporting the forming machine 10, shown in FIGS. 1 and 2, there are provided the deflashing mechanism 12 and the lever forming mechanism 14.

A projection-shaped dovetail 20*a* is set in the longitudinal direction on a base 20. On the front side (toward the loop forming mechanism 16) of the base 20 there is a bending bed 22 set in contact with the loop forming machine. A dovetail groove 24*a* on the lower surface of a slide plate 24 engages the dovetail 20*a* on the upper surface of the base 20 so as to slide. On the upper surface of the slide plate 24 there is a dented groove 26 formed in the longitudinal direction. At the front end of the slide plate 24 there is a step 28 formed at the same height as the groove 26. On the dented groove 26 is provided an action board 30 which is guided by the dented groove 26 to travel freely in the dented groove 26 in the longitudinal direction. At the front end of the action board 30 there is formed an operating board 30*a* extending directly from the upper surface of the action board 30 (extending like a visor of a cap) to provide a space beneath the operating board 30*a*.

A mounting plate 32 (almost half of the mounting plate 32 is put on the step 28) is fixed on the step 28 at the front end of the slide plate 24. The upper surface of plate 32 is almost flush with the lower surface of the operating board 30*a*. Two bottomed holes 30*b* are bored in the longitudinal direction (backward) from the front end face of the action board 30 along the action board 30. Springs 34 are situated in these holes 30*b* so that the front ends of springs 34 in contact with the mounting plate 32 push the action board 30 backward (see FIG. 3). On the upper surface of the action board 30 and operating board 30*a* a groove-shaped dented section 30*c* extends in the backward direction.

A fixed vertical wall 36 in contact with the back end of the base 20 supports a cylinder 38. The front end of the piston 38*a* of the cylinder 38 which is fixed on the vertical wall 36 and driven by air or oil pressure, is connected to the back end of the action board 30.

A stopper block 40 is fixed on the slide plate 24 so as to bridge the dented groove 26. A screw lever 44 is longitudinally screwed on the block 12 fixed on the action board 30 which travels along the dented groove 26 of the slide plate 24. The back end of the screw lever 44 hits the stopper block 40 to set the retire limit of the action board 30.

A locating piece 46 serves to determine the mounting position inputting the metallic binding band 1 on the mounting plate 32. This locating piece 46 is attached via a fixture 48 forming a trapezium (in plan view) fixed on the action board 30, with a part thereof over the mounting plate 32 on the step 28 on the slide plate 24. The portion of the locating piece 46 over the mounting plate 32 is gradually made thinner toward the middle and has a notch 46*a* provided which serves to locate the metallic binding band 1. The flat binding section 2 of the metallic binding band 1 is positioned at this notch 46a. A vertical wall 32*a* is provided facing the locating piece 46 on the mounting plate 32, and the front end of the lever 3 of the metallic binding band 1 hits the vertical wall 32*a* for positioning.

A step 50 is formed on the slide plate side of the bending bed 22, at the same height as the step 28 on the slide plate 24. When the cylinder 38 is driven, the action board 30 slides forward together with the mounting plate 32 since the springs 34 are exerting a pulling-apart force between the mounting plate 32 and the holes 30*b* of the action board 30. The slide plate 24 also slides together with the action board 30 since the slide plate 24 is connected with the mounting plate 32. The end face of the slide plate 24 is brought to collide with the end face of the bending bed 22 (at the same time the end face of the mounting plate 32 hits the vertical face 50*a* of the step 50). The mounting plate 32 is now on both the step 28 of the slide plate 24 and the step 50 of the bending bed 22. The action board 30 is pushed forward against the force of the springs 34 and, therefore, the flat metallic binding band 1 held by the notch 46*a* of the locating piece 46 slides on the mounting plate 32 to a prescribed position on the bending bed 22. At the position of which the lever 3 of the metallic binding band 1 is to be sent, there is provided a lower mold 52 which transforms the lever 3 into the shape of an arc.

The lower mold 52 has a stepped section 52*a* corresponding in shape to the step at the junction between the lever 3 and the binding section 2. An eject pin 56*a* energized by a spring 54 projects movably and freely from the surface of the lower mold 52 (see FIGS. 3 and 4). A punch 56 matching the lower mold 52 is fixed on a traveling block 60 which moves up and down along the supporting pillar 58 provided in parallel with the bending bed 22. This traveling block 60 has a bottom-closed hole 62 bored upward from the lower face of the traveling block 60, and a vertical rod piece 64 extending from the bending bed 22 enters this hole 62. A long spring 66 is provided around the rod piece 64 to energize the traveling block 60 upward (in the direction away from the bending bed 22) (see FIG. 5). At the top section of the supporting pillar 58, a shaft 69 supports an arm 68, whose front end is in contact with the upper face of the traveling block 60 and whose back end is connected to the piston 70*a* of a cylinder 70. With this structure, when the cylinder 70 is driven to extend the piston 70*a* upward, the arm 68 is caused to pivot about the shaft 69, the front end of the arm 68 depressing the traveling block 60. When the driving of the cylinder 70 is released, the force of the spring 66 lifts the traveling block 60.

The deflashing mechanism 12 is provided on the supporting pillar 58 at the side of the base 20. This deflashing mechanism 12 will now be described. A fixing plate 80 is fixed on the supporting pillar 58 so that a side face of the fixing plate 80 is in contact with the traveling block 60. A tapered plane 80*a* at an angle of 45° is formed at the lower section of the fixing plate 80, and a rotary squashing body 82 is provided rotatably on the tapered plane 80*a* to squash the flash of the lever 3 of the metallic binding band 1. A radial bearing, etc. may be used as the rotary squashing body 82. The flash is removed when the flash section of the lever 3 passes under the corner section 82*a* of the rotary squashing body 82. A supporting frame 84 (forming an L-shape in plan view) from the fixing plate 80 is fixed so as to surround the traveling block 60, serving as a guide for the traveling block 60.

A stopper plate 86 is placed in front of the bending bed 22. This stopper plate 86 is guided by a guided groove (not shown) engraved on the machine frame 18 to enable the front of the bending bed 22 to be closed. The stopper plate 86 is connected to a piston 90*a* of a cylinder 90 attached on a fixing piece 88 fixed at the end edge section of the machine frame 18.

Now, the loop forming mechanism 16 will be described. This loop forming mechanism 16 is located on the right side of the machine frame 18 in FIGS. 1 and 2.

Figure 6:
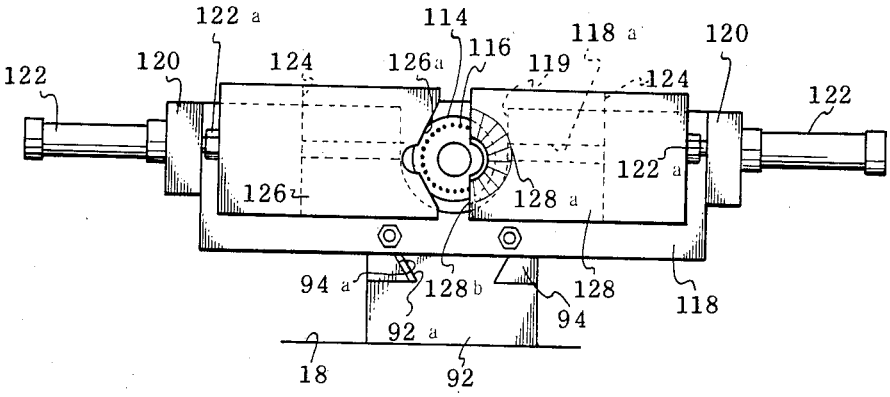
Figure 7:
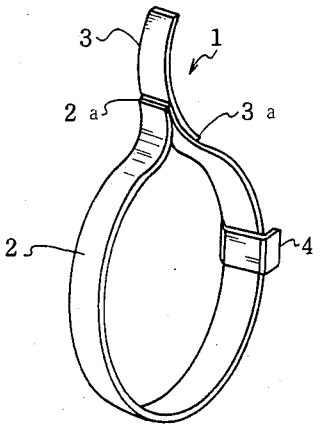
FIG. 7 is a perspective view of a completed metallic binding band before clamping.
Figure 8:
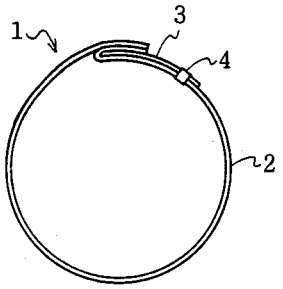
FIG. 8 is a front view of a metallic binding band in the clamped state.
Figure 9:
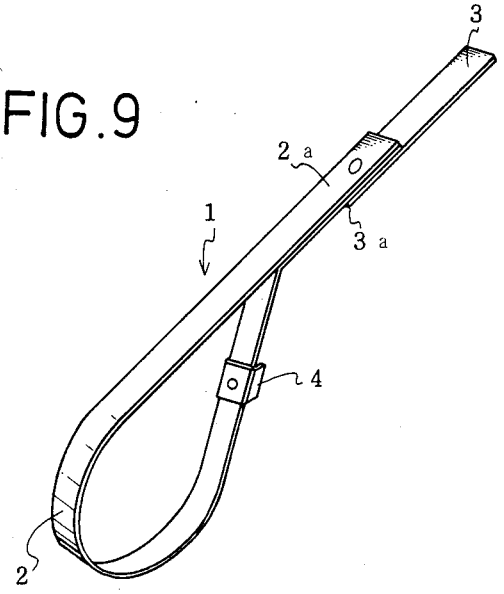
FIG. 9 is a perspective view of a half-manufactured loop-shaped metallic binding band as starting piece.

The loop forming mechanism 16 includes a base 92. On the upper face of the base 92 there is a projected dovetail 92*a* in the longitudinal direction. A dovetail groove 94*a* is formed on the lower face of a slide block 94, engaging slidably and freely with the dovetail 92*a* of the base 92 (see FIG. 6). A fixed plate 96 is provided vertically on the back section of base 92 to support a cylinder 98. The piston 98*a* of this cylinder 98 is connected to the slide block 94, the driving force of the cylinder 98 driving the slide block 94.

A vertical wall 100 is provided on the back upper face of the slide block 94. In the middle of this vertical wall 100 a through-hole 102 is bored, and around this through-hole 102 a plurality of holes are bored to fix the back end of each of a plurality of wire rods 104. A cylinder block 108 is provided on the back face of the vertical wall 100. Cylinder block 108 supports a cylinder 110. A piston 110*a* of the cylinder 110 extends through the through-hole 102 of the vertical wall 100, and is connected to a driving bar 112. A disk-shaped control piece 114 is fixed at the front end of the driving bar 112. The outer circumferential section of this control piece 114 has bored circularly around its circumference as many through-holes 116 as there are wire rods 104. The wire rods 104 extend through the through-holes 116, the front end of each wire rod 104 in the direction of the extensions being a free end.

A guide wall 118 extending in the transverse direction is fixed on the front end face of the slide block 94. A cut section 119 is formed in the middle of this guide wall 118 to allow the wire rods 104 to extend forward. At both ends of the guide wall 118 are attached fixing pieces 120, each of which fixes one of the cylinders 122. Pistons 122*a* of the cylinders 122 are connected to slide pieces 124. On the face of the slide pieces 124 in contact with the guide wall 118 are provided projected sections 124a, which engage with a dented groove 118*a* engraved in the transverse direction on the front face of the guide wall 118, allowing two slide pieces 124 to slide freely and mutually away or to approach.

Pressing plates 126 and 128 are fixed, respectively, on the front faces of the slide pieces 124. At the facing sections of the pressing plates 126 and 128 are formed cut sections 126*a* and 128*a*, which taper and are semicircular in respective middle sections. At the front end of the cut section 128*a* is fixed a guide plate 128*b* which is obtained by cutting a cylindrical body, whose diameter is reduced toward the front, along the axis thereof. With this structure, when the pressing plates 126 and 128 approach each other (shown by two-dots chain line in FIG. 2), front end sections of the wire rods 104, extending forward over the interval between the pressing plates 126 and 128, are pressed towards each other by the respective cut section 126*a* and cut section 128*a* to define a prescribed shape of reduced diameter (shown by two-dots chain line in FIG. 2).

The forming machine according to this invention is constructed as described above. The action of the forming machine will be described below.

(a) First, the flat metallic binding band 1 is mounted on mounting plate 32. In this process, the front end of the lever 3 is put into contact with vertical wall 32*a*, and the flat binding section 2 is positioned in notch 46*a* of the locating piece 46.

(b) The cylinder 38 is driven, and the action board 30, mounting plate 32, and slide plate 24 are caused to slide together along the dovetail 20*a* toward the bending bed 22. The side face of the step 50 of the bending bed 22 contacts the side face of the step 28 of the slide plate 24, and simultaneously, the front end bottom face of the mounting plate 32 advances to contact the step 50 of the bending bed 22.

(c) Then, the action board 30 is pushed, which causes the operating board 30a to advance against the force of the springs 34 between the mounting plate 32 and the action board 30. At the same time, the locating piece 46 fixed on the action board 30 is caused to advance until the metallic binding band 1 is positioned at the lower mold 52 of the bending bed 22. In this process, the lever 3 of the metallic binding band 1 passes under the rotary squashing body 82, where the flash is removed. The dented section 30*c* of the action board 30 and operating board 30*a* is an escape groove for the rotary squashing body 82.

(d) Both the lever 3 and the overlap section (the junction) between the binding section 2 and lever 3 are positioned on the lower mold 52. The punch 56 falls to form the lever 3 and the overlap section into an arc, which has been described above.

(e) While the lever mold 52 and punch 56 are holding the metallic binding band 1, the action board 30 including the operating board 30 and locating piece 46 retracts.

(f) In the loop forming mechanism 16, the cylinders 122 are operated to make the pressing plates 126 and 128 approach each other, front end sections of the wire rods 104 thus being pressed towards each other to reduce the diameter of the space they prescribe (shown by two-dots chain line in FIG. 2). In this state, the cylinder 98 is put into operation to advance the slide block 94. During this advance, the lever 3 is held between the lower mold 52 and punch 56, and the front end of the wire rods 104, whose diameter has been reduced, goes into the binding section 2 which is located a short distance over the lower mold 52. Simultaneously with the rise of the punch 56, the cylinders 122 are retracted to switch the wire rods 104 over from the reduced-diameter state to the state with the front ends (free ends) expanded in diameter, thus contacting and holding the metallic binding band 1.

(g) With the wire rods 104 holding the metallic binding band 1, the cylinder 98 is put into operation to retract the slide block 94 a short distance. Then, the cylinder 90 is put into operation to position the stopper plate 86 in front of the metallic binding band 1.

(h) The cylinder 110 is put into operation to advance the control piece 114 via the driving bar 112. The wire rods 104 are passed outwardly by control piece 114 approximately to the size corresponding to the position of the through-holes 116 of the control piece 114, transforming the binding section 2 of the metallic binding band 1. For this process, the stopper plate 86 is positioned at the back of the metallic binding band 1 to prevent the binding band 1 from coming out of the wire rods 104.

(i) Successively, the cylinder 98 is put into operation to retire the slide block 94. During this process, the cylinder is put into operation to allow the metallic binding band 1 having had its binding section 3 transformed into a circle to drop through the hole 132 on the machine frame 18 between the bending bed 22 and the loop forming mechanism 16 into an underlying suitable accommodation case (not shown).

Subsequently, the same operation is repeated transforming the metallic binding bands into essentially perfect circular loops one by one.

The process described above enables the production of precision metallic binding band 1 composed of a binding section 2 shaped close to an exact circle and a lever 3 shaped in an arc.

The loop forming mechanism of the forming machine given above is capable of transforming a loop-shaped material having a prescribed width into an exact circle. In the above embodiment, a plurality of wire rods have been employed to expand the binding section, but narrow strips, not in the form of rods or wires, may be employed. Besides circular pieces like binding bands, elliptical, triangular, square, polygonal, and other shaped pieces may also be formed if the arrangement of the elongated materials and the form of the holes of the control piece are fitted to the form desired.

As is clear from the above description, the present invention is intended to transform loop-shaped materials (e.g., metallic binding bands) into any prescribed form by inserting a plurality of elongated materials (e.g., wire rods), previously pressed towards each other to define a cross-sectional space of reduced diameter, into a loop and then moving them outwardly to increase the diameter of the space they prescribe and into contact with the loop to re-shape the loop, thus resulting in various significant effects, for example, safe, simple and automatic formation of high-precision loop-shaped materials (e.g., metallic binding bands).

There may also be formed more suitable metallic bindings bands if the lever of the metallic binding band to be formed into a loop is previously formed in the shape of arc.

What we claim is:

1. A method for reforming the shape of an approximately loop-shaped metallic starting piece into a prescribed loop shape comprising:

arranging a plurality of elongated elements substantially parallel to each other throughout their length at prescribed intervals to define the perimeter of a prescribed loop shape having a first diameter, with each of the elongated elements having a fixed back end and a free front end;

then arranging a plurality of pressing apparatus means around the free ends of the elongated elements and activating a drive mechanism to move the pressing means toward each other in a direction substantially perpendicularly to the direction of elongation of the elongated elements thereby to press said free ends toward each other until said free ends define the perimeter of a reduced loop shape having a diameter smaller than said first diameter and said elongated elements are oriented nonparallel to each other;

then inserting said free ends into the loop-shaped starting piece and retracting said pressing apparatus means thereby allowing said free ends of said elongated elements to move away from each other into contact with an inner surface of said starting piece; and then forcing said elongated elements away from each other by means separate from said pressing means thereby to press said elongated elements against said inner surface until the shape of the starting piece is reformed into said prescribed loop shape.

* * * * *